US009845962B2

(12) United States Patent
Niedermann et al.

(10) Patent No.: US 9,845,962 B2
(45) Date of Patent: Dec. 19, 2017

(54) PORTABLE AIR TREATMENT SYSTEM

(71) Applicant: Crane USA Inc., Bensenville, IL (US)

(72) Inventors: Dirk Niedermann, Bloomingdale, IL (US); Kin Wan Li, Hong Kong (CN)

(73) Assignee: Crane USA Inc., Itasca, IL (US)

( * ) Notice: Subject to any disclaimer, the term of this patent is extended or adjusted under 35 U.S.C. 154(b) by 220 days.

(21) Appl. No.: 14/719,706

(22) Filed: May 22, 2015

(65) Prior Publication Data

US 2016/0313016 A1 Oct. 27, 2016

Related U.S. Application Data

(60) Provisional application No. 62/153,256, filed on Apr. 27, 2015.

(51) Int. Cl.

| | |
|---|---|
| ***B01F 3/04*** | (2006.01) |
| ***F24F 6/12*** | (2006.01) |
| *F24F 6/00* | (2006.01) |

(52) U.S. Cl.

CPC ..... *F24F 6/12* (2013.01); *F24F 2006/008* (2013.01); *F24F 2221/12* (2013.01)

(58) Field of Classification Search

CPC . B01F 3/04; B01F 13/002; F24F 6/043; F24F 6/12; F24F 2006/008; F24F 2221/12

USPC ..... 261/81, 104, 107, DIG. 65

See application file for complete search history.

(56) References Cited

U.S. PATENT DOCUMENTS

| | | | | | |
|---|---|---|---|---|---|
| 4,301,093 | A * | 11/1981 | Eck | A61M 15/0085 | 128/200.16 |
| 5,196,171 | A * | 3/1993 | Peltier | A61L 9/127 | 239/34 |
| 5,518,179 | A * | 5/1996 | Humberstone | B05B 17/0646 | 239/102.2 |
| 5,529,055 | A * | 6/1996 | Gueret | B05B 17/0684 | 128/200.16 |
| 5,657,926 | A * | 8/1997 | Toda | B05B 17/0684 | 239/102.1 |
| 5,673,360 | A | 9/1997 | Scripps | | |
| 5,916,493 | A * | 6/1999 | Miller | A61M 16/1075 | 128/204.13 |
| 5,927,618 | A * | 7/1999 | Jefferies | B05B 5/0255 | 239/44 |
| 6,293,474 | B1 * | 9/2001 | Helf | A01M 1/205 | 239/102.1 |
| 6,296,196 | B1 * | 10/2001 | Denen | A01M 1/205 | 239/102.1 |

(Continued)

*Primary Examiner* — Charles Bushey
*Assistant Examiner* — Scott Bushey
(74) *Attorney, Agent, or Firm* — Wood, Phillips, Katz, Clark & Mortimer

(57) ABSTRACT

The combination of: a) an apparatus with a main body and an operating assembly on the main body configured to cause fluid from a supply to be processed so as to become entrained in air in a surrounding atmosphere, wherein the main body has an elongate finger having a length and a free end; and b) a container defining a receptacle for a supply of fluid. The container has an entry opening that is dimensioned to allow the elongate finger on the main body to be directed, free end first, through the entry opening to allow a portion of the length of the elongate finger to be immersed in a supply of fluid in the receptacle. Structure cooperates between the apparatus and container to support the main body and container in an operative relationship.

26 Claims, 10 Drawing Sheets

(56) References Cited

U.S. PATENT DOCUMENTS

| | | | | |
|---|---|---|---|---|
| 6,397,786 | B1 * | 6/2002 | Wu | A61H 33/12 122/31.2 |
| 6,446,880 | B1 * | 9/2002 | Schram | B05B 17/0684 222/570 |
| 6,752,327 | B2 * | 6/2004 | Martens, III | A01M 1/205 239/102.2 |
| 7,017,829 | B2 * | 3/2006 | Martens, III | B05B 17/0684 239/326 |
| 7,182,321 | B2 * | 2/2007 | Huang | F24F 6/00 261/66 |
| 7,775,459 | B2 * | 8/2010 | Martens, III | B05B 17/0646 128/200.14 |
| 2004/0108604 | A1 * | 6/2004 | Pan | F24F 6/00 261/26 |

* cited by examiner

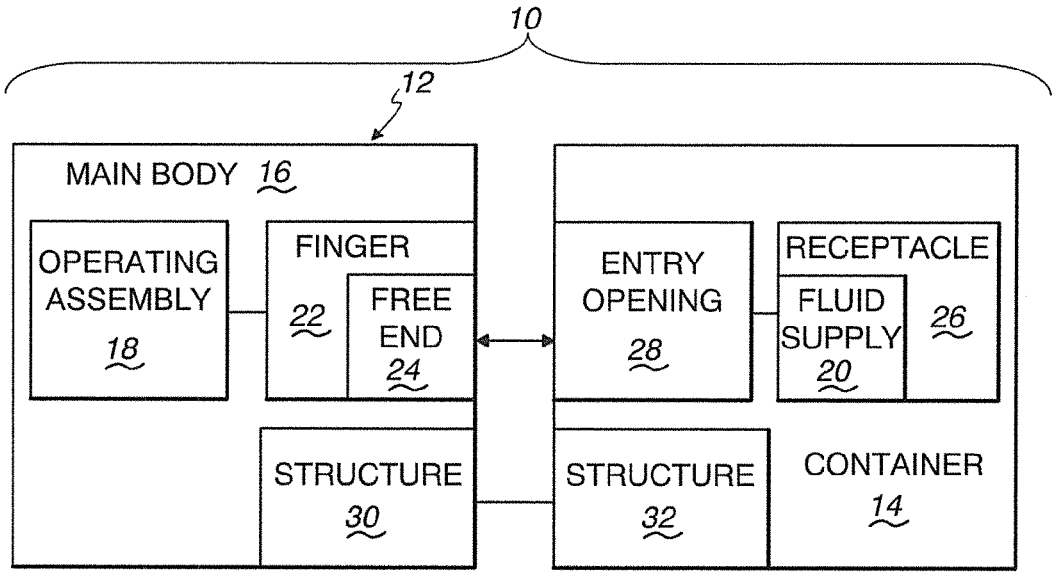
Fig. 1
Fig. 2
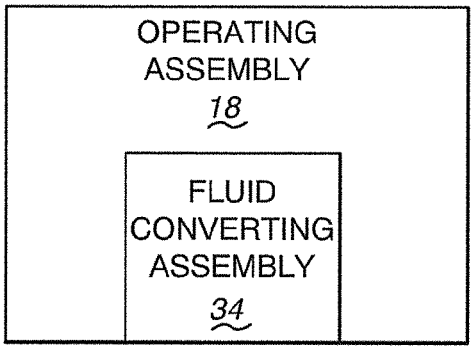
Fig. 3
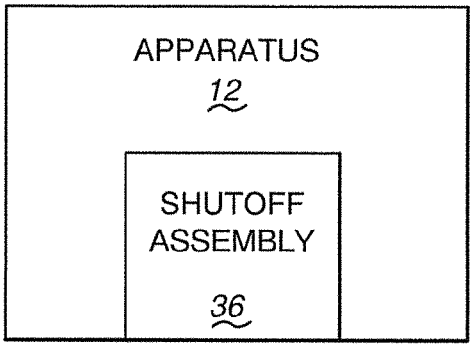

44
96
18
68
98
70
72
46
86
54
66
18
52
82
18
50
82
93
90
92
84
OPERATING ASSEMBLY
18
POWER SUPPLY
74

PORTABLE AIR TREATMENT SYSTEM

BACKGROUND OF THE INVENTION

Field of the Invention

This invention relates to air treatment systems and, more particularly, to a readily transportable system that is usable to cause a fluid to become entrained as a mist and/or vapor in air in a surrounding environment.

Background Art

Myriad "portable" humidifiers have been developed and are commercially available. For purposes of simplicity, the term "humidifier" will be used hereinbelow to identify apparatus that cause any fluid, and preferably water, to be entrained in an atmosphere as a mist and/or vapor.

Most portable humidifiers are designed to treat a single room with a volume typical for a room in a residence. The units are small enough to be lifted and transported from one location to the next. They commonly have a receptacle for a supply of water. The receptacle may be fixed in a housing or separable as a unit to facilitate filling.

There are many environments outside of the home that individuals may be required to occupy that are uncomfortably or excessively dry. For example, travelers staying in hotels and motels are exposed to conditions dictated by the facilities' management. Particularly in winter months during which rooms are treated with relatively dry heated air, the atmospheric conditions may be uncomfortable. For people with chronic conditions requiring humidified air, this can be a particular problem.

U.S. Pat. No. 5,673,360 discloses a humidifying apparatus that is characterized as a "travel humidifier" and designed to be used in a conventional sink. The size and shape are dictated by overall sink geometry and changing water levels therein. As a result, this particular design may be required to be large enough that it is not practical for use as a humidifier that a traveler may transport in his or her luggage.

Other types of "travel humidifiers" have been devised. In an attempt to make these units practically transportable, they have generally been simply downsized with the basic operation and layout of components corresponding to a traditional room humidifier. Thus, the user thereof is required to transport a unit including the components that treat the air and potentially additionally the container that cooperates with the unit and holds a supply of water. Because these humidifiers still may take up a substantial amount of space and commonly have a boxy shape, a traveler may opt not to bring along this type of humidifier in the interest of maximizing luggage space usable for other objects. Luggage space becomes even more significant as airlines place restrictions on luggage size and charge fees for luggage handling.

There remains a need to make available a humidifier that is usable conveniently at different sites in a home and business and that also lends itself to convenient transportation, as when an individual is traveling on public transportation, particularly when the traveling involves the use of luggage.

SUMMARY OF THE INVENTION

In one form, the invention is directed to the combination of: a) an apparatus with a main body and an operating assembly on the main body configured to cause fluid from a supply to be processed so as to become entrained in air in a surrounding atmosphere, wherein the main body has an elongate finger with a length and a free end; and b) a container defining a receptacle for a supply of fluid. The container has an entry opening that is dimensioned to allow the elongate finger on the main body to be directed, free end first, through the entry opening to allow a portion of the length of the elongate finger at the free end to be immersed in a supply of fluid in the receptacle. The combination further includes structure cooperating between the apparatus and container to support the main body and container in an operative relationship wherein a portion of the length of the elongate finger at the free end is immersed in a supply of water in the receptacle to be processed by the apparatus.

In one form, the operating assembly has a fluid converting assembly that is configured to process fluid so that fluid is entrained in the surrounding atmosphere as at least one of: a) a mist; and b) a vapor.

In one form, the container is configured to be grasped and held in a hand of a user to facilitate lifting and transportation of the container.

In one form, the finger has a length extending along a first line. The main body and container are in the operative relationship with the first line extending through a range of different angles relative to the container.

In one form, the container is a drinking glass with an open top region at which the entry opening is formed.

In one form, the operating assembly has a wicking material through which fluid is directed lengthwise of the finger from a supply to the fluid converting assembly.

In one form, the main body has an enlarged head. The enlarged head is configured so that with the finger advanced through the entry opening in the container, a part of the container abuts to the enlarged head to block the main body in its operative relationship with the container.

In one form, the container has a bottom wall with an upwardly facing surface bounding the fluid receptacle. The apparatus and container are configured so that with the main body and container in the operative relationship, the free end of the finger is in spaced relationship with the upwardly facing surface on the bottom container wall.

In one form, the container has a bottom wall with an upwardly facing surface bounding the water receptacle. The apparatus and container are configured so that with the main body and container in the operative relationship, the free end of the finger is abutted to the upwardly facing surface on the bottom container wall.

In one form, the main body has an outer surface that tapers to the free end of the finger and tapers smoothly away from the free end of the finger to and along at least a portion of the enlarged head.

In one form, the invention is provided in combination with a supply of fluid in the container receptacle.

In one form, the operating assembly has a wicking material through which fluid is directed lengthwise of the finger from a supply to the fluid converting assembly. The apparatus further includes a biasing assembly configured to urge the wicking material lengthwise of the finger towards the fluid converting assembly.

In one form, the finger has a slot formed therethrough defining a communication path for fluid in the container receptacle to the wicking material.

In one form, the apparatus has an on state and an off state. The apparatus further includes a shutoff assembly configured to: a) sense that a supply of fluid in the container receptacle is at or below a first level with the main body and container in the operative relationship; and b) cause the apparatus to change from the on state to the off state as an incident of the shutoff assembly sensing that a supply of fluid is at or below the first level.

In one form, the main body has a funnel-shaped surface that directs fluid processed by the water converting assembly out of and away from the apparatus.

In one form, the main body has a top and bottom. The funnel-shaped surface is at the top of the main body.

In one form, the structure cooperating between the apparatus and container consists of at least nominally matching tapered surfaces, one each on the apparatus and container.

In one form, the invention is directed to the above apparatus, apart from the container.

In one form, the invention is directed to a method of processing fluid to generate one of: a) a mist; and b) a vapor to be entrained in a surrounding atmosphere. The method includes the steps of: obtaining the apparatus described above; obtaining a container having an entry opening into a receptacle in which there is a supply of fluid; directing the finger into the receptacle so that: a) a portion of the length of the elongate finger at the free end is immersed in the fluid; and b) the finger is freely movable within the receptacle; and operating the apparatus with the portion of the length of the elongate finger immersed in the fluid.

In one form, the method further includes the step of operating the apparatus with the main body and container in a plurality of different relationships.

BRIEF DESCRIPTION OF THE DRAWINGS

FIG. 1 is a schematic representation of an air treatment system, according to the invention, including an apparatus for processing a fluid and a container for a supply of the fluid;

FIG. 2 is a schematic representation showing further details of an operating assembly on the apparatus in FIG. 1;

FIG. 3 is a schematic representation of an optional shutoff assembly on the apparatus in FIG. 1;

DETAILED DESCRIPTION OF THE PREFERRED EMBODIMENT

Figure 4:
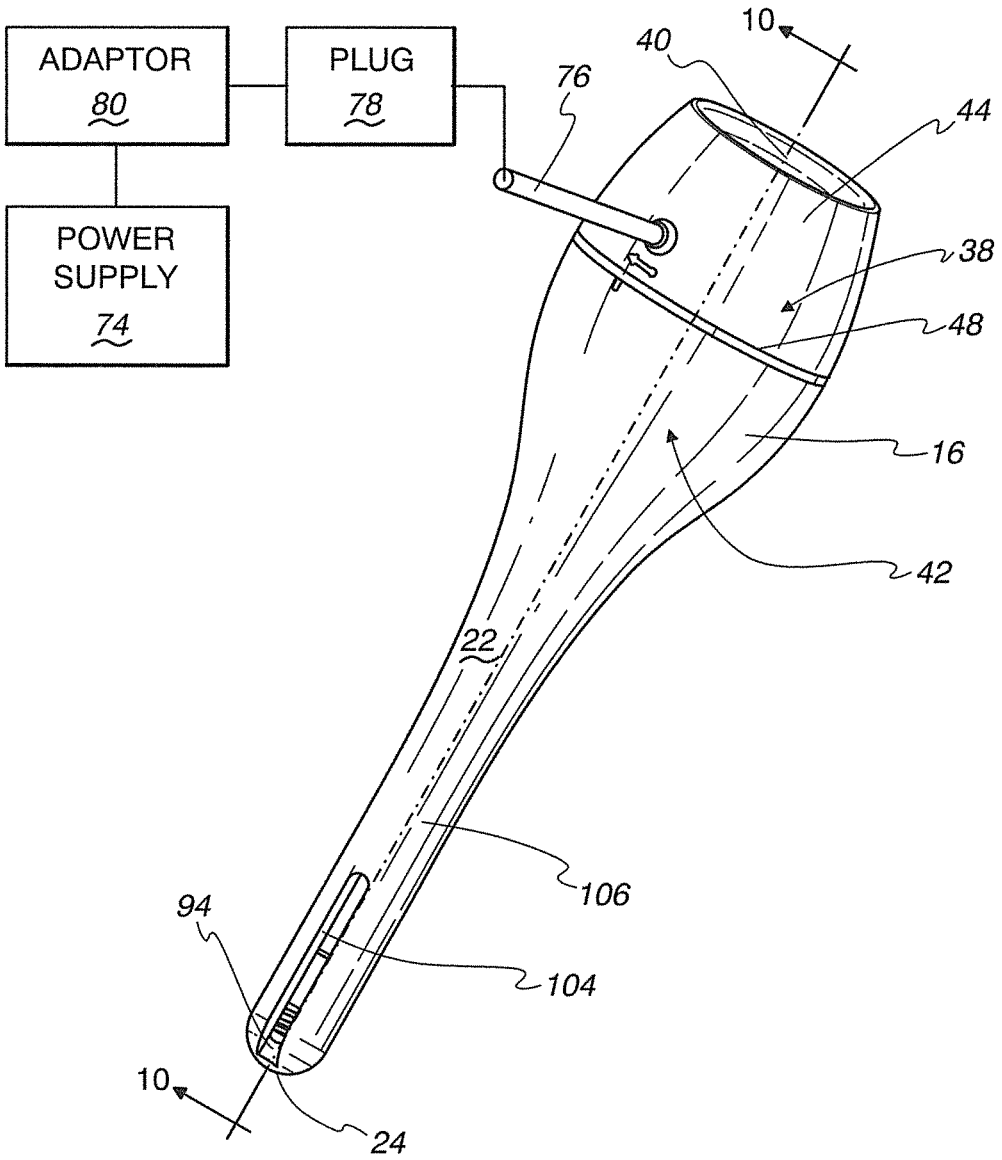
FIG. 4 is a perspective view of one exemplary form of apparatus as shown in FIGS. 1 and 3.
Figure 5:
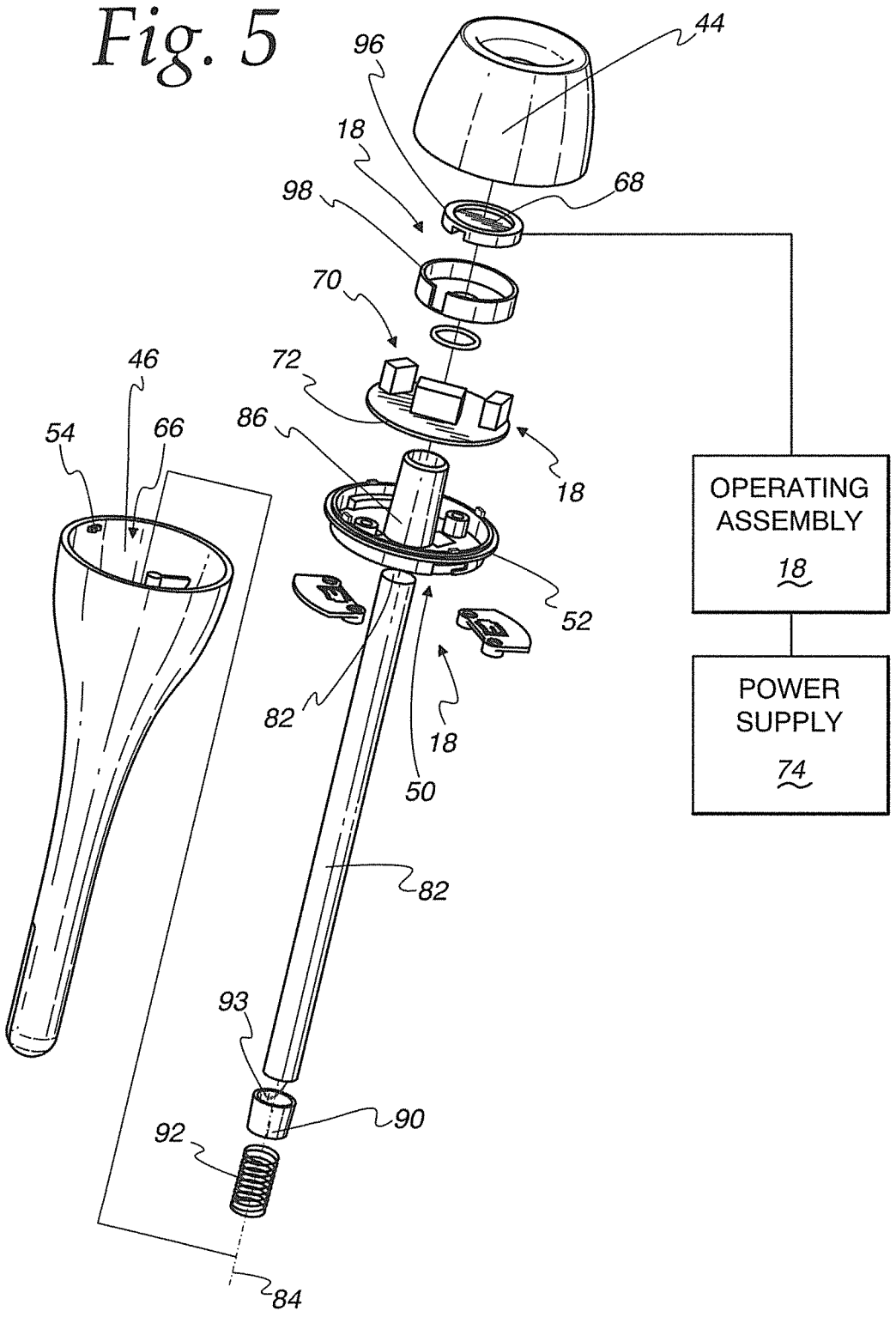
FIG. 5 is an exploded view of the apparatus from the same perspective as in FIG. 4.
Figure 6:
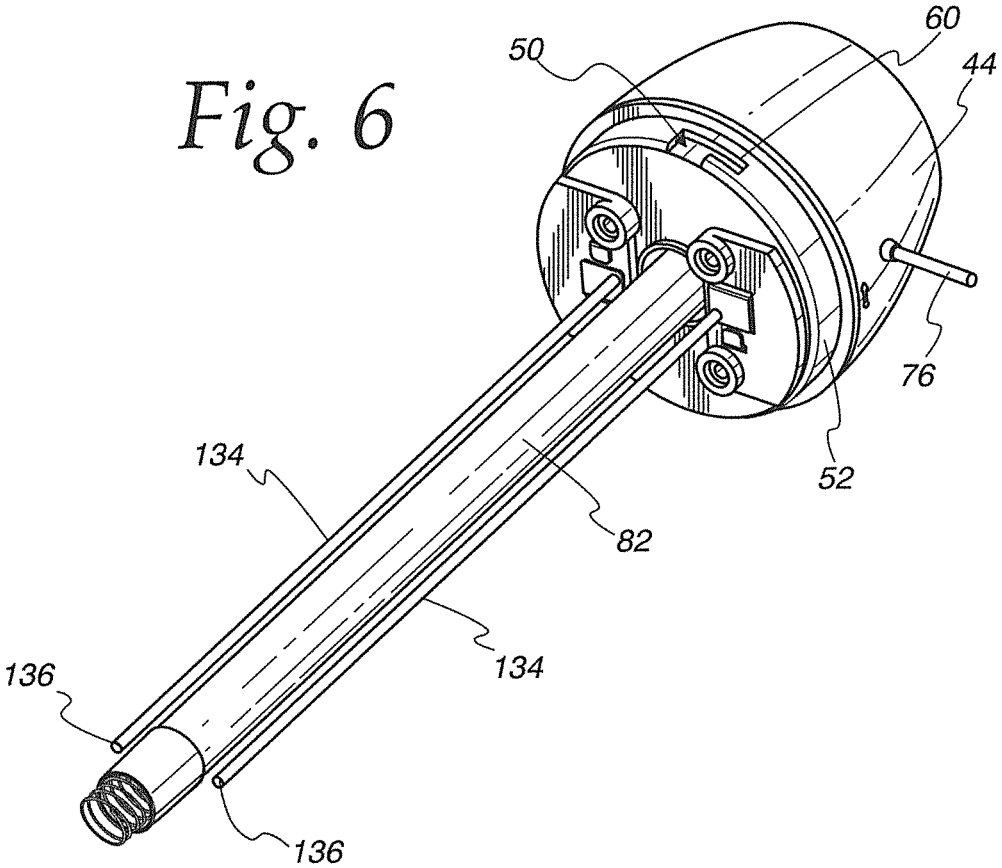
FIG. 6 is an enlarged view as in FIGS. 4 and 5 with parts of a casing removed to expose certain components on an operating assembly.
Figure 7:
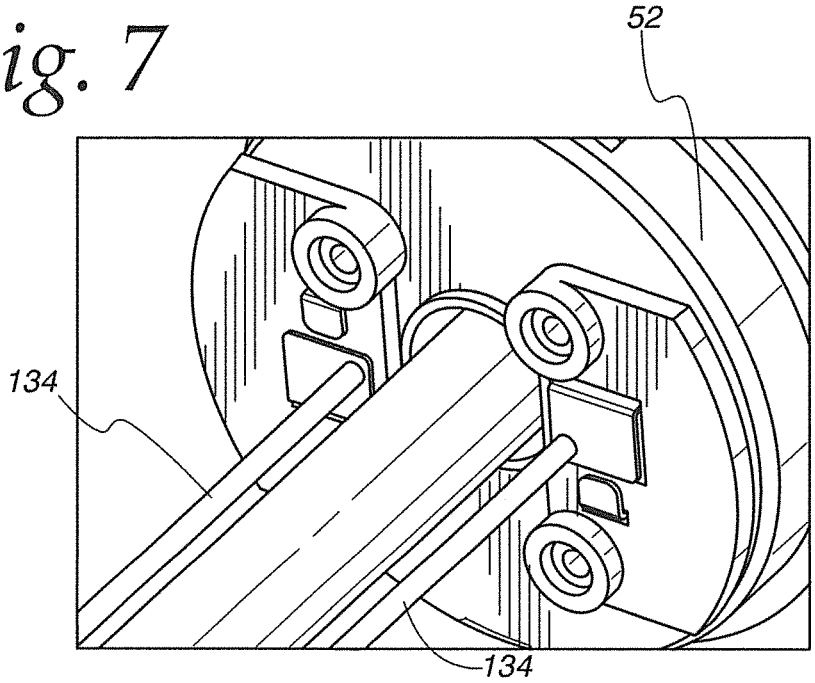
FIG. 7 is a further enlarged view of a portion of the apparatus shown in FIG. 6.
Figure 8:
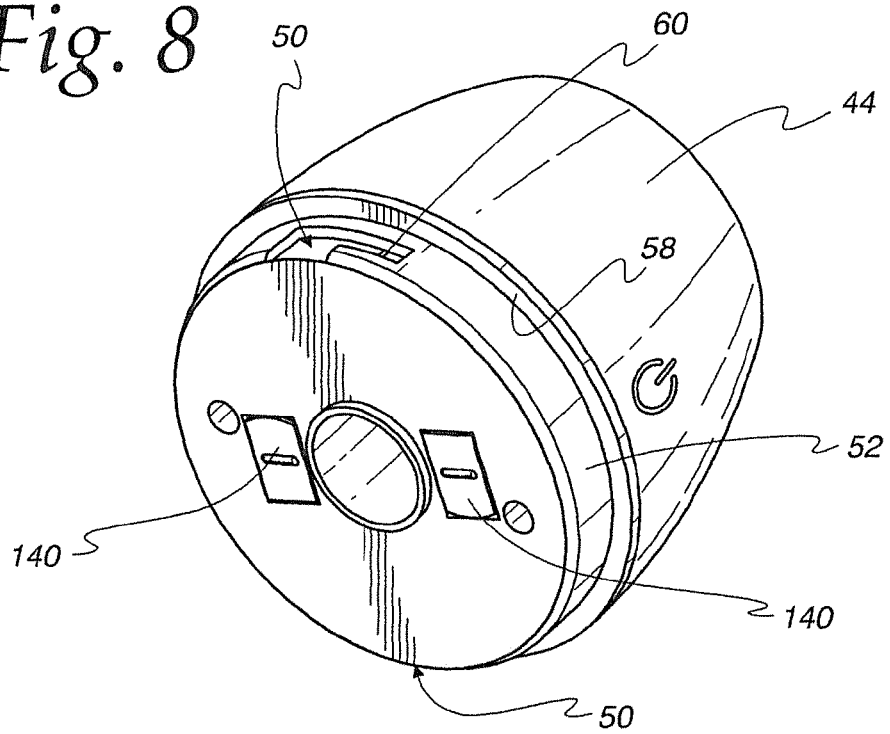
FIG. 8 is an enlarged, perspective view of an upper casing part on the apparatus in FIGS. 4-7.
Figure 9:
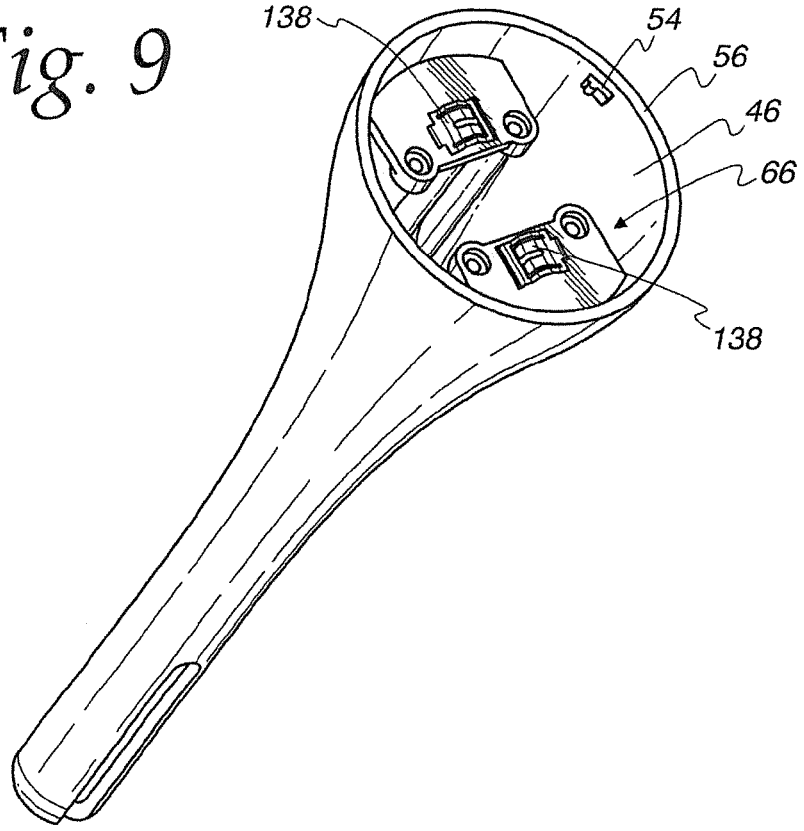
FIG. 9 is an enlarged, perspective view of a lower casing part that is joinable with the casing part in FIG. 8.
Figure 10:
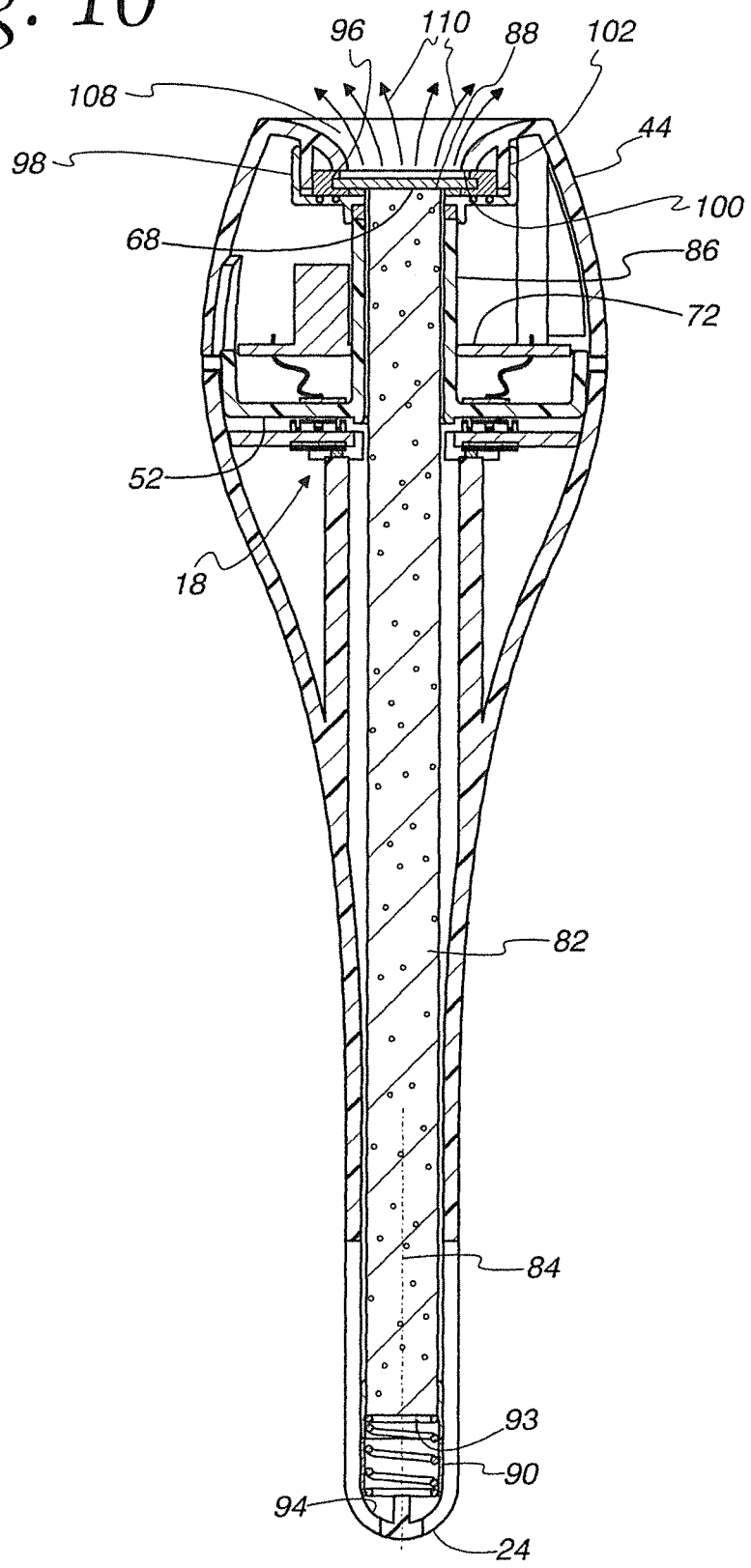
FIG. 10 is a cross-sectional view of the apparatus taken along lines 10-10 of FIG. 4.
Figure 11:
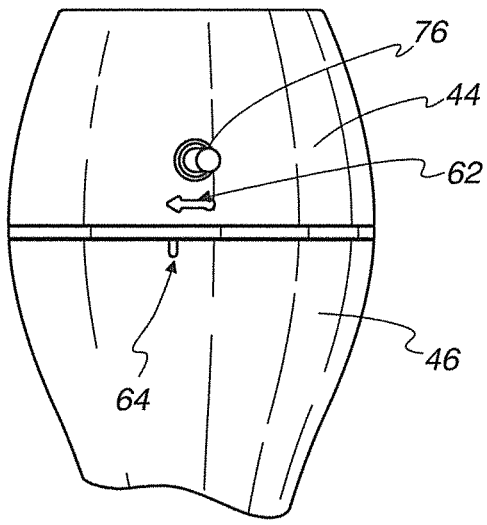
FIG. 11 is an enlarged, fragmentary, elevation view of an upper portion of the apparatus in FIGS. 4-10.

Referring initially to FIG. 1, an air treatment system, according to the present invention, is shown in schematic form at 10. The system 10 consists of an apparatus at 12 and a container at 14 for use in conjunction with the apparatus 12. The apparatus 12 has a main body 16 and an operating assembly at 18 on the main body 16 that is configured to cause fluid from a supply 20 in the container 14 to be processed so as to become entrained in air in a surrounding atmosphere. The main body 16 has an elongate finger 22 with a length and a free end 24.

The container 14 defines a receptacle 26 for the fluid supply 20. The container 14 has an entry opening 28 that is dimensioned to allow the elongate finger 22 to be directed, free end first, through the entry opening 28, normally in a generally downward direction, to allow at least a portion of the length of the elongate finger 22, extending way from the free end 24 thereof, to be immersed in the fluid supply 20 in the receptacle 26.

Structure 30, 32 is provided respectively on the main body 16 and container 14 and cooperates to support the main body 16 and container 14 in an operative relationship wherein at least a portion of the length of the elongate finger 22 is immersed in the fluid in the supply 20 in the receptacle 26 to be processed by the apparatus 12.

The schematic showing of components in FIG. 1 is intended to encompass virtually a limitless number of different component configurations and their interactions. For the most part, the precise configuration of each such component is not critical to the present invention. Critical aspects thereof will be highlighted below with respect to specific embodiments.

As just one example, the precise nature of the processed fluid is not critical, though the same will generally be water.

As seen in FIG. 2, the operating assembly 18 includes a fluid converting assembly 34 that is configured to process fluid from the supply 20 so that the fluid becomes entrained in the surrounding atmosphere as at least one of: a) a mist; and b) a vapor. The schematic showing in FIG. 2 is intended to encompass all conventional structures utilized to process a fluid, such as water, to generate a mist and/or vapor, and variations thereof that would cause similar processing.

As shown in schematic form in FIG. 3, the apparatus 12 may include a shutoff assembly 36 that is operated in response to the level of fluid in the receptacle 26. More specifically, the apparatus 12 is caused to be changed from an "on" state into an "off" state in response to sensing that the fluid in the receptacle 26 is at or below a first level with the main body 16 and container 14 in their operative relationship. Myriad different constructions are contemplated within the generic showing of the shutoff assembly 36 in FIG. 3.

Specific forms of the system 10 and the components thereof will now be described, with the understanding that these specific forms are exemplary in nature only and should not be viewed as limiting given the broader concepts contemplated within the schematic showing in FIGS. 1-3.

As seen in the exemplary form for the apparatus 12 in FIGS. 4-17, the main body 16 has an enlarged head 38 at its top region that blends smoothly into the reduced diameter elongate finger 22 that terminates at the bottom free end 24. The free end 24 has a generally rounded shape. The head 38 has an overall "barrel" shape.

As depicted, the main body 16 has a substantially cylindrical outer cross-sectional configuration taken orthogonally to a central axis 40 over substantially its entire axial extent. While this shape is not required, it provides a smooth, streamlined outer surface 42. This shape is convenient to handle and can be slid conveniently into receptacles for storage and does not tend to hang up on foreign objects in use and during handling and transportation thereof. In the depicted embodiment, the outer surface 42 at the finger 22 tapers slightly from the head 38 to the free end 24 to facilitate its use, as described hereinbelow.

The main body 16 includes separate casing parts 44, 46 that meet at a parting line 48 at the head 38. Diametrically opposite, L-shaped slots 50 are provided on an upwardly opening cup-shaped insert 52 secured to the casing part 44. The slots 50 cooperate, one each, with a pair of alignable projections 54 (one shown in FIG. 9). With the casing parts 44, 46 initially separated, the projections 54 can be aligned with the slots 50, whereupon the casing parts 44, 46 can be moved axially towards each other to direct the projections 54 into the slots 50. This relative movement continues until an upper annular edge 56 on the casing part 46 abuts an oppositely facing annular edge 58 on the insert 52, whereupon the parts can be relatively turned to lock the projections 54 in circumferentially extending portions 60 of each slot 50 to thereby releasably secure the casing parts 44, 46 together. The casing parts 44, 46 can be separated by reversing the connecting steps described above.

Alignable indicia 62, 64 are respectively provided on the casing parts 44, 46 to facilitate alignment of the slots 50 and projections 54 and to give a visual indication that the casing parts 44, 46 are in a secured angular relationship with respect to the axis 40.

The casing parts 44, 46, once connected, cooperatively bound a chamber 66 within which the operating assembly 18 resides. The operating assembly 18 is supported cooperatively by the casing parts 44, 46 and the insert 52 captively held therebetween. The operating assembly 18 is shown partially in schematic form, as in FIG. 5, to avoid discussion of details that are not critical to understanding the present invention.

Briefly, the operating assembly 18 utilizes a conventional-type nebulizer membrane 68 to make up the fluid converting assembly 34. Through known electronic components on the operating assembly 18, electric current is used to produce high-frequency vibrations that break up the fluid into tiny particles that become suspended in the surrounding atmosphere. As noted above, the details of the structure for effecting the vibration of the membrane 68 are not significant. Components capable of accomplishing this are shown generally at 70 on a printed circuit board 72, and further schematically in FIG. 5.

The operating assembly 18 is connected to a power supply 74. The power supply 74 may be self-contained, as by using batteries. As depicted, the power supply 74 is connected to the operating assembly 18 through a cord 76 that has an end plug 78. The plug 78 might be one that can be inserted directly into a household power receptacle. Alternatively, the plug 78 may be a USB connector that is connected through an adaptor 80 to the power supply 74.

As noted above, the invention contemplates, without limitation, use of other types of structure to make up the fluid converting assembly 34 that processes the fluid to create the fluid particles.

Fluid/water is delivered to the membrane 68 from the supply 20 through a wicking component 82. The wicking component 82 is made from a suitable material, such as cotton, that also filters fluid passed therethrough to avoid delivery of contaminants to the membrane 68. As depicted, the wicking component 82 has an elongate cylindrical shape with a central axis 84 concentric with the axis 40 of the main body 16.

The insert 52 has an integrally formed sleeve 86 which surrounds an upper region of the wicking component 82 to maintain its concentric alignment with the main body 16. The sleeve 86 also stabilizes the top surface 88 of the wicking component 82 that is placed facially against the membrane 68.

The bottom of the wicking component 82 fits into a sleeve 90 that closely surrounds the bottom of the wicking component 82 to maintain its shape. The bottom of the wicking component 82 is biased upwardly by a coil spring 92 interposed between the bottom surface 93 of the wicking component 82 and an upwardly facing surface 94 at the bottom of the finger 22 and bounding part of the chamber 66. The spring 92 makes up a biasing assembly that may have other configurations, so long as the wicking component 82 is caused to be urged upwardly towards the membrane 68.

The membrane 68 is held by, or embedded in, a rubber ring 96 which seats in a cup-shaped support 98. With the insert 52 assembled on the casing part 44, the sleeve 86 extends through the PC board 72 and bears against the support 98 so that the rubber ring 96 is captive between the support 98 and a downwardly facing annular edge 100 defined at the top region of the casing part 44. The support 98 closely surrounds a depending annular skirt 102 formed on the casing part 44, thereby to cause the support 98 to be stabilized.

A slot 104 is formed through a wall 106 on the finger 22 bounding the chamber 66. The slot 104 extends axially to admit fluid into the chamber 66 to saturate the material on the wicking component 82. The axial extent of the slot and its circumferential width control the volume of fluid that is admitted into the chamber 66 with the finger 22 immersed in fluid.

With the finger 22 immersed in fluid in the supply 20, the fluid communicates through the slot 104 to the wicking component 82 and is caused to move upwardly through the wicking component 82 eventually into contact with the membrane 68. The vibrating membrane 68 generates fluid mist or vapor that discharges upwardly from the top of the casing part 44. The casing part 44 defines a funnel-shaped guide surface 108 that diverges away from the edge 100 that bears on the rubber ring 96. The configuration of the surface 108 causes the entrained fluid to disperse upwardly and radially outwardly, as indicated by the arrows 110 in FIG. 10.

Figure 12:
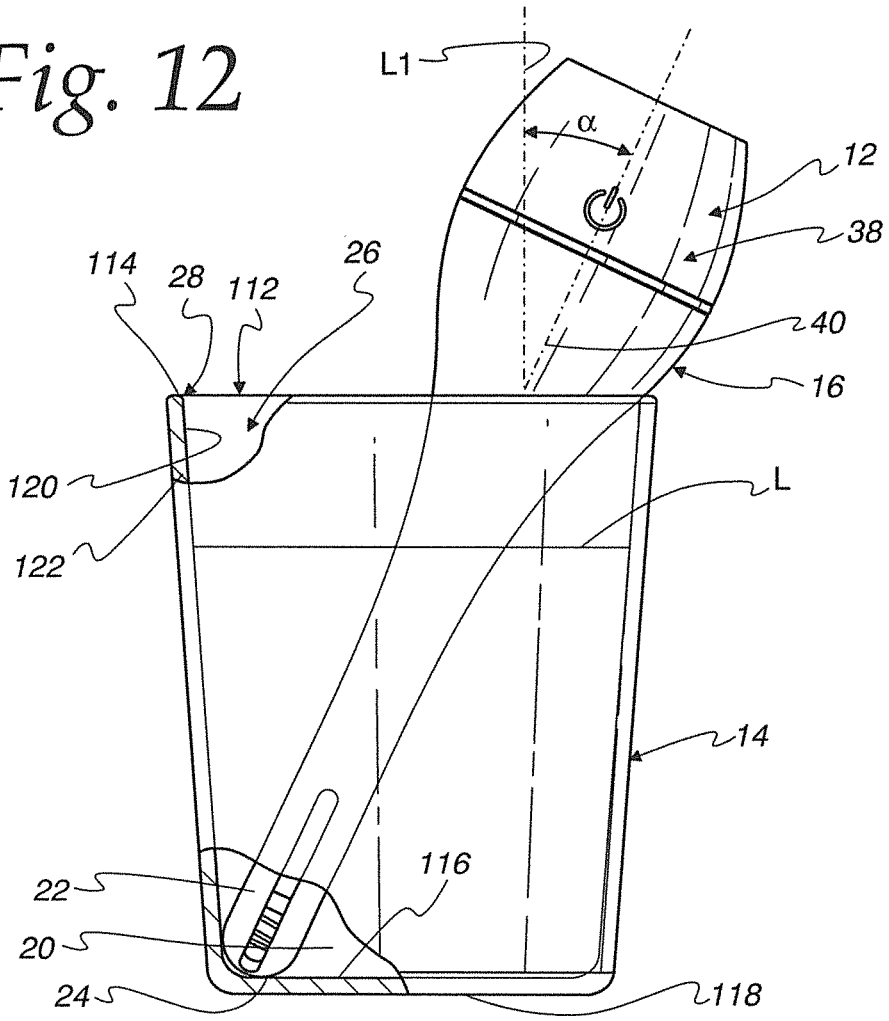
FIG. 12 is an elevation view of the apparatus in FIGS. 4-11 with the main body thereon in operative relationship to a container in the form of a drinking glass with a supply of fluid therein.
Figure 13:
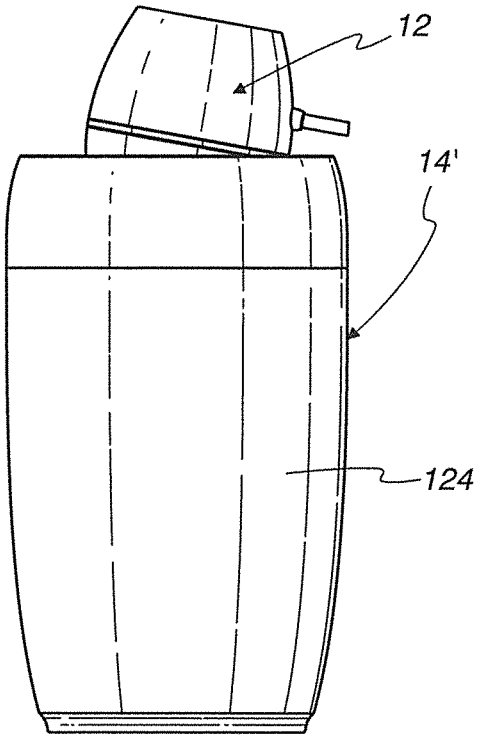
FIG. 13 is a side elevation view of the apparatus in FIGS. 4-12 with the main body thereon in operative relationship to a modified form of container.
Figure 14:
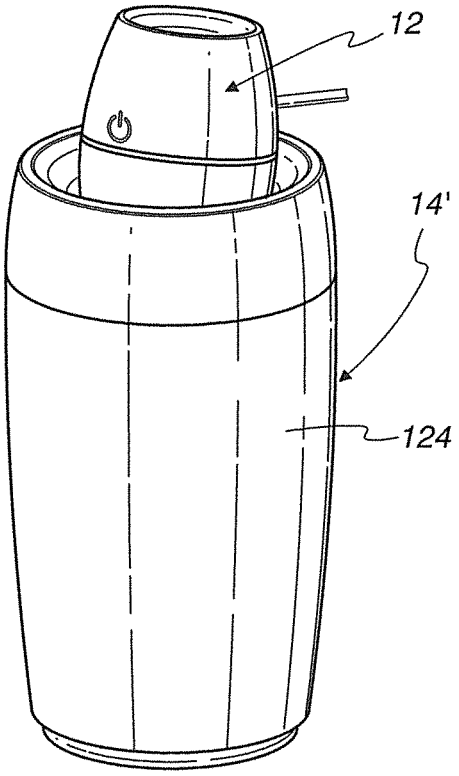
FIG. 14 shows the components in FIG. 13 from a different perspective.
Figure 15:
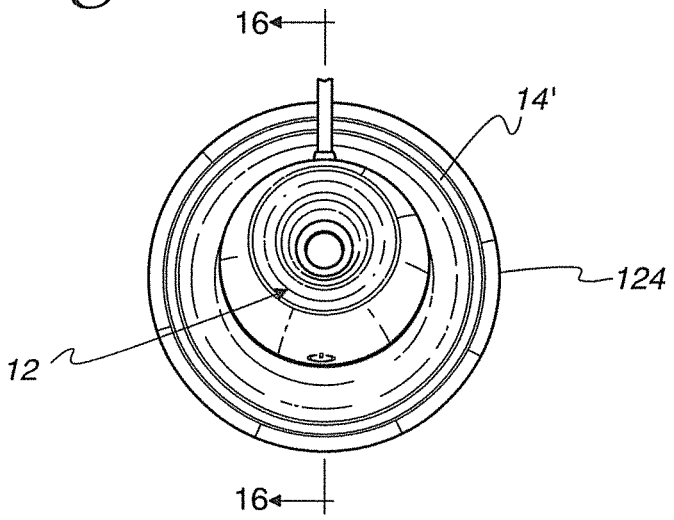
FIG. 15 is a plan view of the components in FIGS. 13 and 14.
Figure 16:
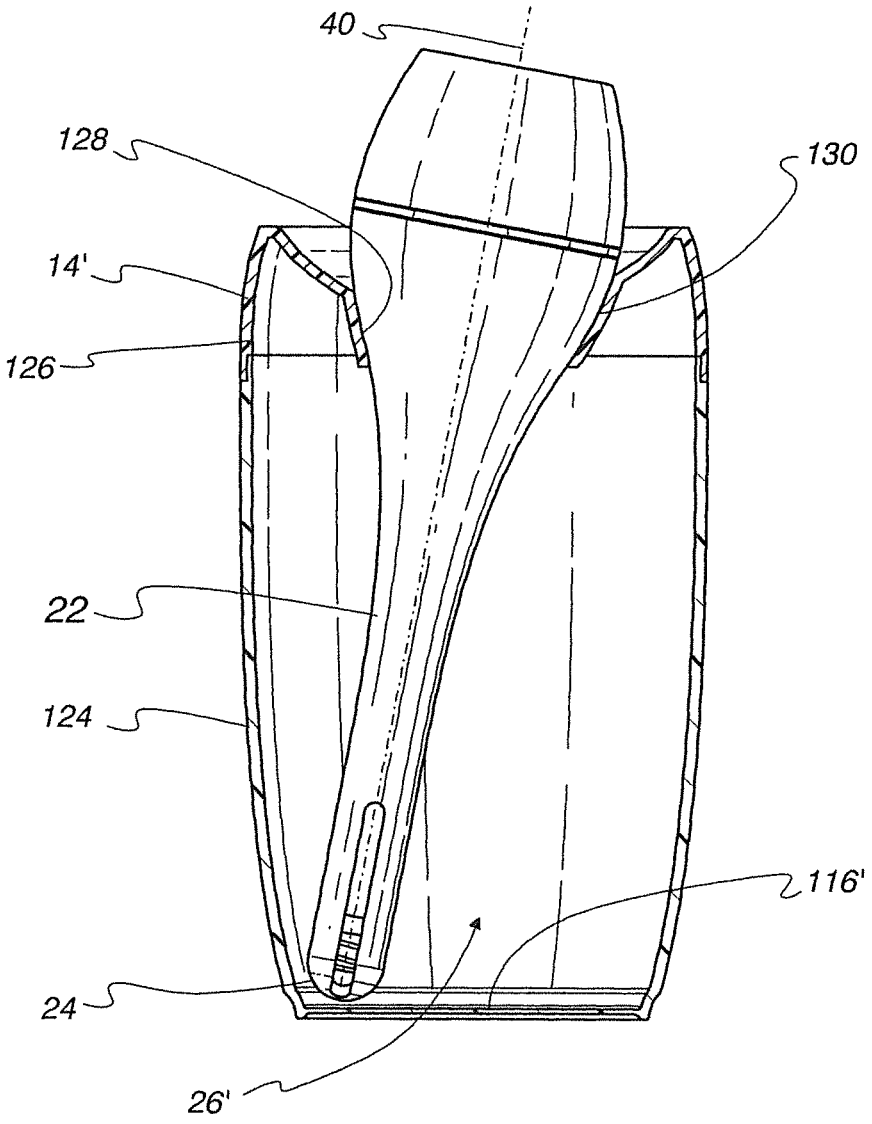
FIG. 16 is a cross-sectional view of the components taken along line 16-16 of FIG. 15.

The container 14 may take many different forms. In its simplest form, the container 14, as seen in FIG. 12, is in the form of a conventional drinking glass that may be maintained on a suitable support as the apparatus is operated. The drinking glass 14 has an open top region at 112 at which the entry opening 28 is formed, bounded by an annular edge 114.

In FIG. 12, the main body 16 and container/glass 14 are in their operative relationship. The free end 24 of the finger 22 bears against an upwardly facing surface 116 on a bottom wall 118 of the container/glass 14. The finger 22 wedges at a juncture between the bottom wall surface 116 and an annular surface 120 defined by a peripheral wall 122 extending around the receptacle 26 in which the fluid in the supply 20 is retained up to the level L in FIG. 12.

With this particular container/glass configuration, the head 38 bears on the edge 114 so that the finger 22 and head 38 cooperate with the container/glass 14 to stably support the apparatus 12 with the central axis 40 at an angle a to a vertical line L1. The angular arrangement allows the user to controllably direct the discharging fluid particles towards an area where they are more strategically entrained relative to the user's location. While the invention contemplates that the axis 40 might be vertically situated, this arrangement might result in the delivery of a significant volume of the entrained particles above the user location where they may not be efficiently or effectively utilized.

By simply changing the drinking glass 14 to one with a different size and/or shape, the manner in which the apparatus 12 interacts therewith through the various components that engage and make up the structures 30, 32, described above, and its precise operating orientation, may be changed.

The weight distribution of components on the apparatus 12 is also such that the apparatus 12 might be supported substantially entirely by the finger 22 that bridges between two locations on a drinking glass, such as the drinking glass 14, but lower in height.

Alternatively, as shown in FIGS. 13-16, a container 14' may be custom designed for the apparatus 12. In this embodiment, the container 14' is made with a main body 124 that bounds the fluid receptacle 26' and a cap 126 that is fit thereto. The cap 126 has an annular seating surface 128 making up the structure 32, described above, that cooperates with an annular surface portion 130 on the main body 124, that makes up the structure 30, described above. The seating surface 128 and surface portion 130 are complementarily tapered and shaped so that as the finger 22 is directed downwardly into the receptacle 26', the seating surface 128 and surface portion 130 are guided into a final relationship wherein they interact to maintain the main body 16 in a desired angular orientation relative to the container 14'. As seen most clearly in FIG. 16, with this configuration, the axis 40 resides at approximately 10° to vertical. Any angle may be built into the design.

In this embodiment, the main body 18 is supported entirely by the cooperating seating surface 128 and surface portion 130 with the free end 24 of the finger 22 spaced above the bottom wall surface 116' that faces upwardly on the container 14'.

Figure 17:
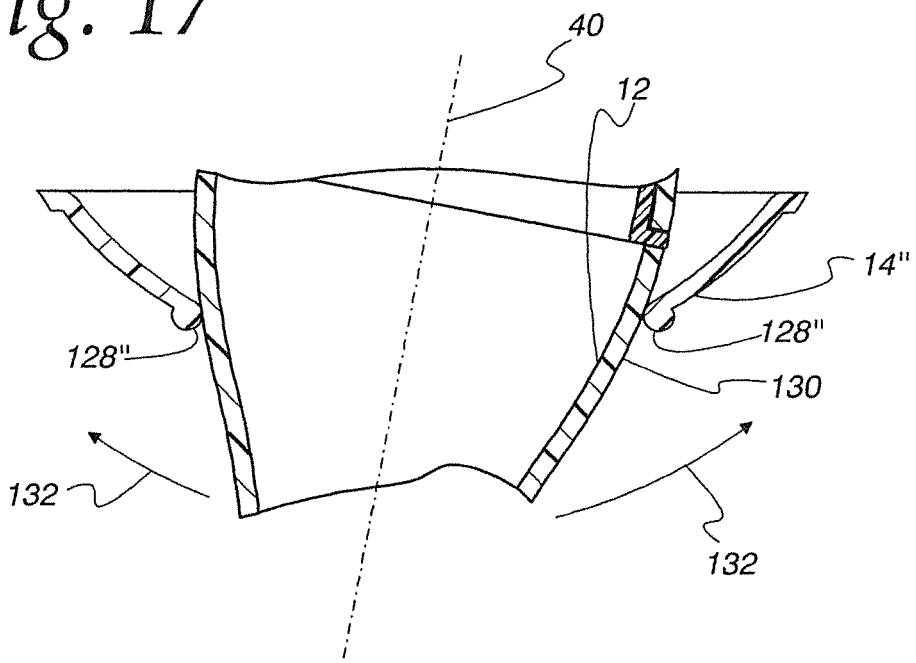
FIG. 17 is a fragmentary, cross-sectional view showing cooperating structure on the apparatus in FIGS. 4-16 and a further modified form of container.

In FIG. 17 a variation of the receptacle 14' is shown at 14", wherein the annular seating surface 128" is defined so that the surface portion 130 may bear thereagainst to allow the apparatus 12 to be supported by the receptacle 14" but to be pivotable guidingly oppositely, as shown by the arrows 132, thereby to change the angular orientation of the axis 40.

While the dimensions and precise configuration of the apparatus 12 and container 14, 14', 14" may vary, ideally each of the apparatus 12 and container 14, 14', 14" is made so that it can be readily grasped in the hand of a user to facilitate lifting and transportation of the container. For example, ideally the diameter of the enlarged head 38 is such that it can be readily fit in the palm of a user's hand and grasped by the fingers on the same hand. A diameter of 1½-2½inches for the enlarged head 38 is convenient, but should not be viewed as limiting. The overall length of the apparatus may be in the range of 4-7 inches. Again, this is only a desired range and the length could be substantially less or greater than the lower and upper limits of this range.

Many other features can be incorporated into the inventive structure. As one example, electrodes 134, making up the aforementioned shutoff assembly, may each extend lengthwise through the portion of the chamber 66 defined by the finger 22 to a free end 136 in the vicinity of the slot 104 through which fluid is communicated from the supply 20 to the wicking component 82. With the main body 16 and container 14, 14', 14" in operative relationship and the fluid at or above a first level, both electrode ends 136 are exposed to the fluid and complete a circuit through the PC board 72 to which they are connected. When the fluid is below the first level, one of the electrode ends 136 is not immersed in the fluid, or both electrode ends 136 are not immersed in the fluid, whereby the operating circuit is interrupted. The operating assembly 18 is configured so that once this occurs, the apparatus 12 changes from an "on" state to an "off" state. The shutoff assembly 36 prevents operation of the apparatus 12 without fluid present and alerts a user to add fluid to the supply 20.

Further, the circuit with which the electrodes 134 are associated may be configured so that circuit continuity is broken once the casing parts 44, 46 are turned relative to each other preparatory to effecting their separation. This is made possible by incorporating contacts 138 on the casing part 46, electrically connected to the electrodes 134, that engage contacts 140 on the casing part 44 with the casing parts 44, 46 turned to be secured together.

Figure 18:
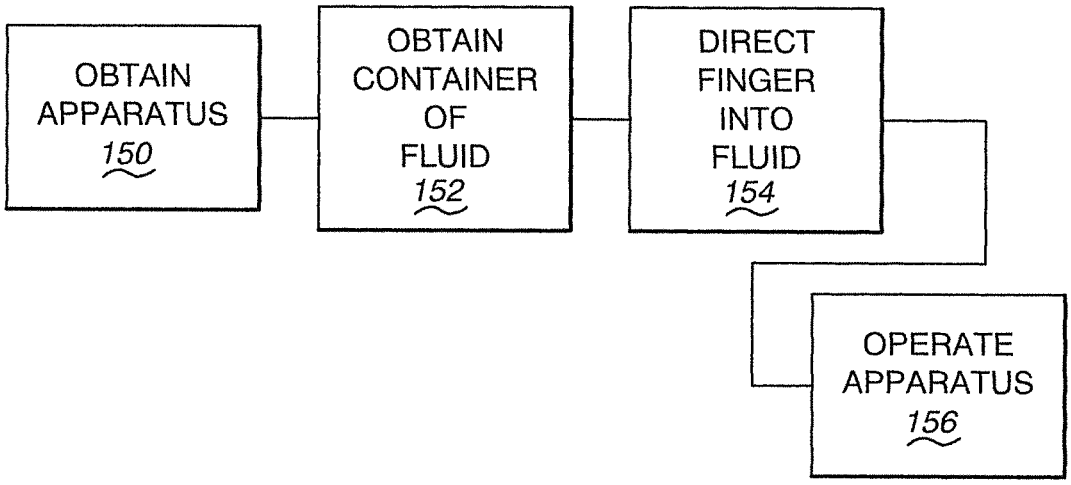
FIG. 18 is a flow diagram representation of a method for processing fluid to generate one of: a) a mist; and b) a vapor to be entrained in a surrounding atmosphere, according to the present invention.

The overall configuration of the apparatus 12, including the elongate finger 22, allows the apparatus 12 to be used in association with any container that holds a supply of fluid and has an entry opening. The finger 22 acts as a simple probe that can be directed into the fluid and potentially even held by a user without requiring interaction with the particular container. Its rounded free end 24 and tapering shape facilitates finger introduction, The entry opening has a diameter substantially greater than a diameter of the finger 22 in the region adjacent its free end, whereby a substantial length of the finger 22 can be directed into the container without interference. The relationship of the apparatus 12 and container can be maintained simply by the weight of the apparatus 12 or through a frictional fit. Regardless of the precise configuration of the apparatus and container, a method as shown in flow diagram form in FIG. 18 can be carried out.

As shown at block 150, an apparatus as described above is obtained.

As shown at block 152, a container of fluid is obtained. The container may be a normal drinking glass, a container customized for the apparatus, or may even be a pool of fluid that allows use of the apparatus without interaction with the container. For example, a user may manually suspend the apparatus with the finger projected into the fluid supply.

As shown at block 154, the finger is directed into the fluid in a receptacle so that: a) a portion of the length of the elongate finger at the free end is immersed in the fluid; and b) the finger is freely movable within the receptacle. This free movement may be a guided pivoting movement. Alternatively, the finger may be movable vertically relative to the receptacle to be separated from the container. "Freely movable" is intended to encompass structure wherein the apparatus is not fixedly secured to a container.

The apparatus is then operated, as indicated at block 156.

The foregoing disclosure of specific embodiments is intended to be illustrative of the broad concepts comprehended by the invention.

The invention claimed is:

1. In combination:

a) an apparatus comprising:

a main body; and an operating assembly on the main body configured to cause fluid from a supply to be processed so as to become entrained in air in a surrounding atmosphere, wherein the main body comprises an elongate finger having a length and a free end; and b) a container defining a receptacle for a supply of fluid, the container having an entry opening that is dimensioned to allow the elongate finger on the main body to be directed, free end first, through the entry opening to allow a portion of the length of the elongate finger at the free end to be immersed in a supply of fluid in the receptacle;

the combination further comprising structure cooperating between the apparatus and container to support the main body and container in an operative relationship wherein a portion of the length of the elongate finger at the free end is immersed in a supply of fluid in the receptacle to be processed by the apparatus, wherein the main body bears downwardly against, and is supported by, the container with the main body and container in the operative relationship and the container maintained on a support as tthe apparatus is operated, wherein with the main body and container in the operative relationship, the elongate finger bears against the container.

2. The combination according to claim 1 wherein the operating assembly comprises a fluid converting assembly that is configured to process fluid so that fluid is entrained in the surrounding atmosphere as at least one of: a) a mist; and b) a vapor.

3. The combination according to claim 1 wherein the container is configured to be grasped and held in a hand of a user to facilitate lifting and transportation of the container.

4. The combination according to claim 1 wherein the finger has a length extending along a first line and the main body and container are in the operative relationship with the first line extending through a range of different angles relative to the container.

5. The combination according to claim 1 wherein the container comprises a drinking glass with an open top region at which the entry opening is formed.

6. The combination according to claim 2 wherein the operating assembly comprises a wicking material through which fluid is directed lengthwise of the finger from a supply to the fluid converting assembly.

7. The combination according to claim 1 wherein the main body comprises an enlarged head, the enlarged head configured so that with the finger advanced through the entry opening in the container, a part of the container abuts to the enlarged head to block the main body in its operative relationship with the container.

8. The combination according to claim 1 wherein the container has a bottom wall with an upwardly facing surface bounding the fluid receptacle and the apparatus and container are configured so that with the main body and container in the operative relationship, the free end of the finger is abutted to the upwardly facing surface on the bottom container wall.

9. The combination according to claim 1 further in combination with a supply of fluid in the container receptacle.

10. The combination according to claim 7 wherein the operating assembly comprises a wicking material through which fluid is directed lengthwise of the finger from a supply to the fluid converting assembly and the apparatus further comprises a biasing assembly configured to urge the wicking material lengthwise of the finger towards the fluid converting assembly.

11. The combination according to claim 6 wherein the finger has a slot formed therethrough defining a communication path for fluid in the container receptacle to the wicking material.

12. The combination according to claim 1 wherein the apparatus has an on state and an off state and further comprises a shutoff assembly configured to: a) sense that a supply of fluid in the container receptacle is at or below a first level with the main body and container in the operative relationship; and b) cause the apparatus to change from the on state to the off state as an incident of the shutoff assembly sensing that a supply of fluid is at or below the first level.

13. The combination according to claim 2 wherein the main body has a funnel-shaped surface that directs fluid processed by the fluid converting assembly out of and away from the apparatus.

14. The combination according to claim 13 wherein the main body has a top and bottom and the funnel-shaped surface is at the top of the main body.

15. The combination according to claim 1 wherein the structure cooperating between the apparatus and container comprises at least nominally matching tapered surfaces, one each on the apparatus and container.

16. A method of processing fluid to generate one of: a) a mist; and b) a vapor to be entrained in a surrounding atmosphere, the method comprising the steps of:

obtaining the apparatus of claim 1;

obtaining a container having an entry opening into a receptacle in which there is a supply of fluid;

directing the finger into the receptacle so that: a) a portion of the length of the elongate finger at the free end is immersed in the fluid; and b) the finger is freely movable within the receptacle; and operating the apparatus with the portion of the length of the elongate finger immersed in the fluid.

17. The method of processing water according to claim 16 further comprising the step of operating the apparatus with the apparatus and container in a plurality of different relationships.

18. The method of processing water according to claim 17 wherein the plurality of different relationships are a plurality of different angular relationships between the length of the elongate finger and the container.

19. The combination according to claim 1 wherein the main body has a lengthwise axis and the main body does not extend radially beyond the finger over the length of the finger.

20. The combination according to claim 1 wherein the main body has a central axis and an outer surface that is substantially cylindrically shaped as viewed in cross section orthogonally to the central axis over a majority of an axial extent of the main body.

21. In combination:

a) an apparatus comprising:

a main body: and an operating assembly on the main body configured to cause fluid from a supply to be processed so as to become entrained in air in a surrounding atmosphere, wherein the main body comprises an elongate finger having a length and a free end; and b) a container defining a receptacle for a supply of fluid, the container having an entry opening that is dimensioned to allow the elongate finger on the main body to be directed, free end first, through the entry opening to allow a portion of the length of the elongate finger at the free end to be imersed in a supply of fluid in the receptacle;

the combination further comprising structure cooperating between the apparatus and container to support the main body and container in an operative relationship wherein a portion of the length of the elongate finger at the free end is immersed in a supply of fluid in the receptacle to be processed by the apparatus, wherein the main body comprises an enlarged head, the enlarged head configured so that with the finger advanced through the entry opening in the container, a part of the container abuts to the enlarged head to block the main body in its operative relationship with the container, wherein the main body has an outer surface that tapers to the free end of the finger and tapers smoothly away from the free end of the finger to and along at least a portion of the enlarged head.

22. The combination according to claim 21 wherein the container has a bottom wall with an upwardly facing surface bounding the fluid receptacle and the apparatus and container are configured so that with the main body and container in the operative relationship, the free end of the finger is in spaced relationship with the upwardly facing surface on the bottom container wall.

23. In combination:

a) an apparatus comprising:

a main body; and an operating assembly on the main body configured to cause fluid from a supply to be processed so as to become entrained in air in a surrounding atmosphere, wherein the main body comprises an elongate finger having a length and a free end; and b) a container defining a receptacle for a supply of fluid, the container having an entry opening that is dimensioned to allow the elongate finger on the main body to be directed, free end first, through the entry opening to allow a portion of the length of the elongate finger at the free end to be immersed in a supply of fluid in the receptacle;

the combination further comprising structure cooperating between the apparatus and container to support the main body and container in an operative relationship wherein a portion of the length of the elongate finger at the free end is immersed in a supply of fluid in the receptacle to be processed by the apparatus, wherein the finger has a length extending along a first line and the main body and container are in the operative relationship with the first line extending through a range of different permitted angles relative to the container.

24. In combination:

a) an apparatus comprising:

a main body; and an operating assembly on the main body configured to cause fluid from a supply to be processed so as to become entrained in air in a surrounding atmosphere, wherein the main body comprises an elongate finger having a length, a diameter, and a free end; and b) a container defining a receptacle for a supply of fluid, the container having an entry opening that is dimensioned to allow the elongate finger on the main body to be directed, free end first, through the entry opening to allow a portion of the length of the elongate finger at the free end to be immersed in a supply of fluid in the receptacle, the entry opening having a diameter substantially greater than the diameter at the free end of the finger whereby a substantial length of the finger can be directed through the entry opening without any interference between the main body and container;

the combination further comprising structure cooperating between the apparatus and container to support the main body and container in an operative relationship wherein a portion of the length of the elongate finger at the free end is immersed in a supply of fluid in the receptacle to be processed by the apparatus, wherein the structure cooperating between the apparatus and container comprises a curved surface on one of the apparatus and container that cooperates with a surface on the other of the apparatus and container to guide relative movement between the container and apparatus so that an angular relationship between the length of the elongate finger and the container can be changed.

25. In combination:

a) an apparatus comprising:

a main body; and an operating assembly on the main body configured to cause fluid from a supply to be processed so as to become entrained in air in a surrounding atmosphere, wherein the main body comprises an elongate finger having a length and a free end; and b) a container defining a receptacle for a supply of fluid, the container having an entry opening that is dimensioned to allow the elongate finger on the main body to be directed, free end first, through the entry opening to allow a portion of the length of the elongate finger at the free end to be immersed in a supply of fluid in the receptacle;

the combination further comprising structure cooperating between the apparatus and container to support the main body and container in an operative relationship wherein a portion of the length of the elongate finger at the free end is immersed in a supply of fluid in the receptacle to be processed by the apparatus, wherein the main body bears downwardly against, and is supported by, the container with the main body and container in the operative relationship and the container maintained on a support as the apparatus is operated, wherein the main body has a funnel-shaped surface that directs fluid processed by the fluid converting assembly out of and away from the apparatus.

26. In combination:

a) an apparatus comprising:

a main body; and an operating assembly on the main body configured to cause fluid from a supply to be processed so as to become entrained in air in a surrounding atmosphere, wherein the main body comprises an elongate finger having a length and a free end; and b) a container defining a receptacle for a supply of fluid, the container having an entry opening that is dimensioned to allow the elongate finger on the main body to be directed, free end first, through the entry opening to allow a portion of the length of the elongate finger at the free end to be immersed in a supply of fluid in the receptacle;

the combination further comprising structure cooperating between the apparatus and container to support the main body and container in an operative relationship wherein a portion of the length of the elongate finger at the free end is immersed in a supply of fluid in the receptacle to be processed by the apparatus, wherein the main body bears downwardly against, and is supported by, the container with the main body and container in the operative relationship and the container maintained on a support as the apparatus is operated, wherein the structure cooperating between the apparatus and container comprises at least nominally matching tapered surfaces, one each on the apparatus and container.

* * * * *